US011904997B1

(12) United States Patent
Wald et al.

(10) Patent No.: US 11,904,997 B1
(45) **Date of Patent: *Feb. 20, 2024**

(54) METHODS FOR MANEUVERING A MARINE VESSEL

(71) Applicant: Brunswick Corporation, Mettawa, IL (US)

(72) Inventors: Benjamin C. Wald, Perkins, OK (US); Brad E. Taylor, Stillwater, OK (US); Kenneth G. Gable, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/085,861

(22) Filed: Dec. 21, 2022

Related U.S. Application Data

(63) Continuation of application No. 17/115,059, filed on Dec. 8, 2020, now Pat. No. 11,565,783, which is a continuation of application No. 16/375,278, filed on Apr. 4, 2019, now Pat. No. 10,913,524.

(51) Int. Cl.
*B63H 25/02* (2006.01)
*B63H 25/42* (2006.01)
*B63H 20/12* (2006.01)

(52) U.S. Cl.
CPC ..... *B63H 25/02* (2013.01); *B63H 20/12* (2013.01); *B63H 25/42* (2013.01); *B63H 2025/026* (2013.01)

(58) Field of Classification Search
CPC ..... B63H 25/00; B63H 25/02; B63H 25/42; B63H 2025/026; B63H 20/00; B63H 20/12
USPC ..... 114/144 R
See application file for complete search history.

(56) References Cited

U.S. PATENT DOCUMENTS

| | | | |
|---|---|---|---|
| 4,747,359 | A | 5/1988 | Ueno |
| 6,273,771 | B1 | 8/2001 | Buckley et al. |
| 6,957,990 | B2 | 10/2005 | Lowe |
| 6,994,046 | B2 | 2/2006 | Kaji |
| 7,121,219 | B1 | 10/2006 | Stallings |

(Continued)

FOREIGN PATENT DOCUMENTS

DE 102007057600 A1 6/2008

OTHER PUBLICATIONS

Wald et al., "Methods for Maneuvering a Marine Vessel," U.S. Appl. No. 17/115,059, filed Dec. 8, 2020 (specification, claims, and drawings only).

*Primary Examiner* — Lars A Olson
(74) *Attorney, Agent, or Firm* — Andrus Intellectual Property Law, LLP

(57) ABSTRACT

A method for maneuvering a marine vessel includes receiving an input signal from an analog user input device and comparing a magnitude of the input signal to a predetermined threshold. In response to the magnitude of the input signal being less than the predetermined threshold, the method includes actuating a first marine propulsion device to produce thrust. In response to the magnitude of the input signal being greater than or equal to the predetermined threshold, the method includes actuating the first marine propulsion device and a second marine propulsion device to produce thrust. The second marine propulsion device does not produce thrust when the magnitude of the input signal is less than the predetermined threshold.

16 Claims, 6 Drawing Sheets

(56) References Cited

U.S. PATENT DOCUMENTS

| | | | | |
|---|---|---|---|---|
| 7,222,577 | B2 | 5/2007 | Morvillo | |
| 7,305,928 | B2 | 12/2007 | Bradley et al. | |
| 7,467,595 | B1 | 12/2008 | Lanyi et al. | |
| 7,601,040 | B2 | 10/2009 | Morvillo | |
| 8,478,464 | B2 | 7/2013 | Arbuckle et al. | |
| 8,807,059 | B1 | 8/2014 | Samples et al. | |
| 9,039,468 | B1 | 5/2015 | Arbuckle et al. | |
| 9,132,903 | B1 | 9/2015 | Gable et al. | |
| 9,387,916 | B2 | 7/2016 | Skauen | |
| 9,434,460 | B1 | 9/2016 | Samples et al. | |
| 9,988,134 | B1 | 6/2018 | Gable et al. | |
| 10,562,602 | B1 | 2/2020 | Gable et al. | |
| 10,913,524 | B1 | 2/2021 | Wald et al. | |
| 11,565,783 | B1 * | 1/2023 | Wald | B63H 25/02 |
| 2008/0027597 | A1 | 1/2008 | Barrett et al. | |
| 2008/0189001 | A1 | 8/2008 | Morvillo | |
| 2011/0166724 | A1 | 7/2011 | Hiramatsu | |
| 2011/0172858 | A1 | 7/2011 | Gustin et al. | |
| 2015/0307176 | A1 | 10/2015 | Nakayasu | |

* cited by examiner

| THRUSTER STATUS | | TILT INPUT | | | |
|---|---|---|---|---|---|
| | | NONE | FORE | AFT | PORT/STBD |
| ROTATION INPUT | CW < THRESH | BOW TO PORT | BOW TO PORT | STERN TO STBD | BOW TO PORT |
| | CW > THRESH | BOW TO PORT; STERN TO STBD | BOW TO PORT; STERN TO STBD | STERN TO STBD; BOW TO PORT | BOW TO PORT; STERN TO STBD |
| | CCW < THRESH | BOW TO STBD 502 | BOW TO STBD | STERN TO PORT | BOW TO STBD |
| | CCW > THRESH | BOW TO STBD; STERN TO PORT | BOW TO STBD; STERN TO PORT | STERN TO PORT; BOW TO STBD | BOW TO STBD; STERN TO PORT |

504 508 506

FIG. 5

| THRUSTER STATUS | | TILT INPUT | | | | |
|---|---|---|---|---|---|---|
| | | NONE | FORE | AFT | PORT | STBD |
| ROTATION INPUT | CW < THRESH | BOW TO PORT | BOW TO PORT | STERN TO STBD | BOW AND STERN TO STBD | BOW AND STERN TO PORT |
| | CW > THRESH | BOW TO PORT; STERN TO STBD | BOW TO PORT; STERN TO STBD | STERN TO STBD; BOW TO PORT | BOW TO PORT; STERN TO STBD | BOW TO PORT; STERN TO STBD |
| | CCW < THRESH | BOW TO STBD | BOW TO STBD | STERN TO PORT | BOW AND STERN TO STBD | BOW AND STERN TO PORT |
| | CCW > THRESH | BOW TO STBD; STERN TO PORT | BOW TO STBD; STERN TO PORT | STERN TO PORT; BOW TO STBD | BOW TO STBD; STERN TO PORT | BOW TO STBD; STERN TO PORT |

602 604

FIG. 6

606

| THRUSTER STATUS | | TILT INPUT | | | | |
|---|---|---|---|---|---|---|
| | | NONE | FORE | AFT | PORT | STBD |
| ROTATION INPUT | CW < THRESH | BOW TO PORT | BOW TO PORT | STERN TO STBD | STERN TO STBD | BOW TO PORT |
| | CW > THRESH | BOW TO PORT; STERN TO STBD | BOW TO PORT; STERN TO STBD | STERN TO STBD; BOW TO PORT | BOW TO PORT; STERN TO STBD | BOW TO PORT; STERN TO STBD |
| | CCW < THRESH | BOW TO STBD | BOW TO STBD | STERN TO PORT | BOW TO STBD | STERN TO PORT |
| | CCW > THRESH | BOW TO STBD; STERN TO PORT | BOW TO STBD; STERN TO PORT | STERN TO PORT; BOW TO STBD | BOW TO STBD; STERN TO PORT | BOW TO STBD; STERN TO PORT |

FIG. 7

702

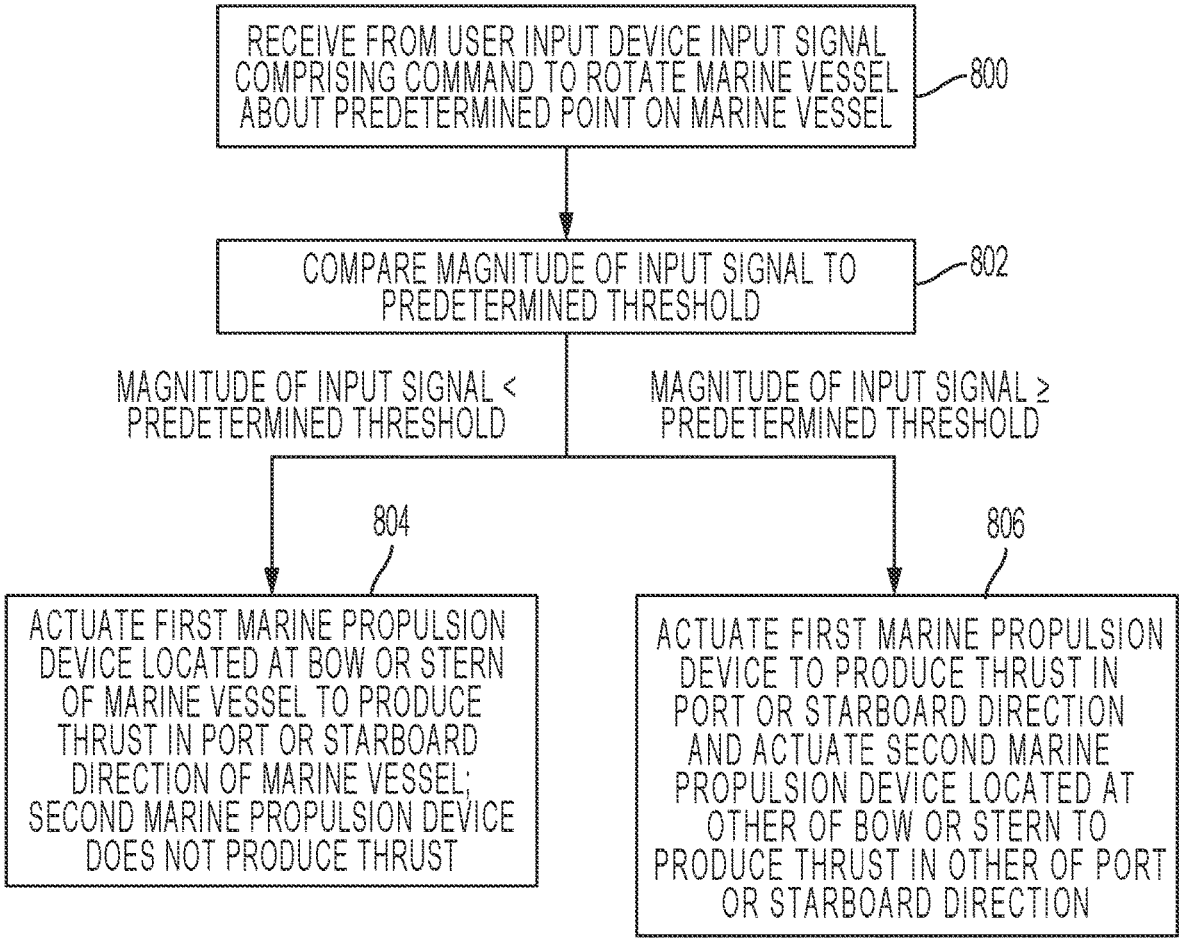

FIG. 8

METHODS FOR MANEUVERING A MARINE VESSEL

CROSS-REFERENCE TO RELATED APPLICATIONS

This application is a continuation of U.S. application Ser. No. 17/115,059, filed on Dec. 8, 2020, which is a continuation of U.S. application Ser. No. 16/375,278, filed on Apr. 4, 2019, now U.S. Pat. No. 10,913,524, issued Feb. 9, 2021, both of which are hereby incorporated herein by reference.

FIELD

The present disclosure relates to maneuvering marine vessels having marine propulsion devices at a bow and a stern thereof.

BACKGROUND

U.S. Pat. No. 6,273,771, which is incorporated herein by reference in entirety, discloses a control system for a marine vessel incorporating a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,467,595, which is incorporated herein by reference in entirety, discloses a method for controlling the movement of a marine vessel, including rotating one of a pair of marine propulsion devices and controlling the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. Pat. No. 9,132,903, which is incorporated herein by reference in entirety, discloses systems and methods for maneuvering a marine vessel having a plurality of steerable propulsion devices. The plurality of propulsion devices are controlled to achieve a lateral movement by controlling the steering orientation of port and starboard propulsion devices so that forward thrusts provided by the port and starboard propulsion devices intersect at or forwardly of a center of turn of the marine vessel. One of the port and starboard propulsion devices is operated to provide a forward thrust and the other of the port and starboard propulsion devices is operated to provide a reverse thrust so that the lateral movement is achieved and a resultant yaw component is applied on the marine vessel. An intermediate propulsion device is controlled to apply an opposing yaw component on the marine vessel that counteracts the resultant yaw component.

U.S. Pat. Nos. 8,807,059 and 9,434,460, which are incorporated herein by reference in entirety, disclose systems for maneuvering a marine vessel comprising an input device for requesting lateral movement of the marine vessel with respect to the longitudinal axis and a plurality of propulsion devices including at least a port propulsion device, a starboard propulsion device and an intermediate propulsion device disposed between the port and starboard propulsion devices. A control circuit controls orientation of the port and starboard propulsion devices inwardly towards a common point on the marine vessel, and upon a request for lateral movement of from the input device, operates one of the port and starboard propulsion devices in forward gear, operates the other of the port and starboard propulsion devices in reverse gear, and operates the intermediate propulsion device in reverse gear.

U.S. Pat. No. 9,988,134, which is incorporated herein by reference in entirety, discloses systems and methods for controlling movement of a marine vessel extending along a longitudinal axis between a bow and a stern and along a lateral axis between a port side and a starboard side, having a first propulsion device located closer to the stern than to the bow and steerable about a first steering axis perpendicular to the longitudinal and lateral axes, a second propulsion device located closer to the bow than to the stern and steerable about a second steering axis perpendicular to the longitudinal and lateral axes. An input device is configured to input a request for movement of the marine vessel. A control module is configured to control steering and thrust of the first and second propulsion devices to achieve a resultant movement of the marine vessel commensurate with the request for movement.

U.S. Pat. No. 10,562,602, which is incorporated herein by reference in entirety, discloses a marine propulsion system including an engine-powered propulsion device coupled in torque-transmitting relationship with an engine. A non-engine-powered propulsion device is coupled to a source of electric or hydraulic power. A control module is provided in signal communication with the engine-powered propulsion device and the non-engine-powered propulsion device. A user-operated input device is in signal communication with the control module. The marine propulsion system operates in a non-engine-powered propulsion mode in response to the control module determining the following: the engine was previously running; a speed of the engine is below an engine-stopped speed threshold; the marine propulsion system is on; and a request for movement of the vessel has been input via the user-operated input device. While the marine propulsion system operates in the non-engine-powered propulsion mode, the control module controls the non-engine-powered propulsion device to generate thrust to maneuver the vessel according to the request for movement.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a method for maneuvering a marine vessel includes receiving an input signal from an analog user input device and comparing a magnitude of the input signal to a predetermined threshold. In response to the magnitude of the input signal being less than the predetermined threshold, the method includes actuating a first marine propulsion device to produce thrust. In response to the magnitude of the input signal being greater than or equal to the predetermined threshold, the method includes actuating the first marine propulsion device and a second marine propulsion device to produce thrust. The second marine propulsion device does not produce thrust when the magnitude of the input signal is less than the predetermined threshold.

According to another example of the present disclosure, a method for maneuvering a marine vessel includes receiving from a user input device an input signal comprising a command to rotate the marine vessel about a predetermined point on the marine vessel and comparing a magnitude of the input signal to a predetermined threshold. In response to the magnitude of the input signal being less than the predetermined threshold, the method includes actuating a first marine propulsion device located at one of a bow or a stern of the marine vessel to produce thrust in one of a port or a starboard direction of the marine vessel. In response to the magnitude of the input signal being greater than or equal to the predetermined threshold, the method includes actuating the first marine propulsion device to produce thrust in the one of the port or the starboard direction and actuating a second marine propulsion device located at the other of the bow or the stern to produce thrust in the other of the port or the starboard direction. The second marine propulsion device does not produce thrust when the magnitude of the input signal is less than the predetermined threshold.

According to another example of the present disclosure, a method for maneuvering a marine vessel includes receiving a rotational input at a joystick having a handle that is rotatable about an axis of the handle and tiltable with respect to a base of the joystick in a fore direction, an aft direction, a port direction, and a starboard direction of the marine vessel. The method includes measuring a magnitude of an input signal corresponding to the rotational input and comparing the magnitude of the input signal to a predetermined threshold. In response to the magnitude of the input signal being less than the predetermined threshold, the method includes actuating one of a bow thruster or a stern thruster to produce thrust in one of the port direction or the starboard direction. In response to the magnitude of the input signal being greater than or equal to the predetermined threshold, the method includes actuating the bow thruster to produce thrust in one of the port direction or the starboard direction and actuating the stern thruster to produce thrust in the other of the port direction or the starboard direction. The other of the bow thruster or the stern thruster does not produce thrust when the magnitude of the input signal is less than the predetermined threshold.

BRIEF DESCRIPTION OF THE DRAWINGS

Systems and methods for maneuvering a marine vessel are described with reference to the following Figures. The same numbers are used throughout the Figures to reference like features and like components.

FIGS. 5, 6, and 7 show exemplary input-output tables for carrying out a portion of a method according to the present disclosure.

FIG. 8 illustrates another method according to the present disclosure.

DETAILED DESCRIPTION

Figure 1:
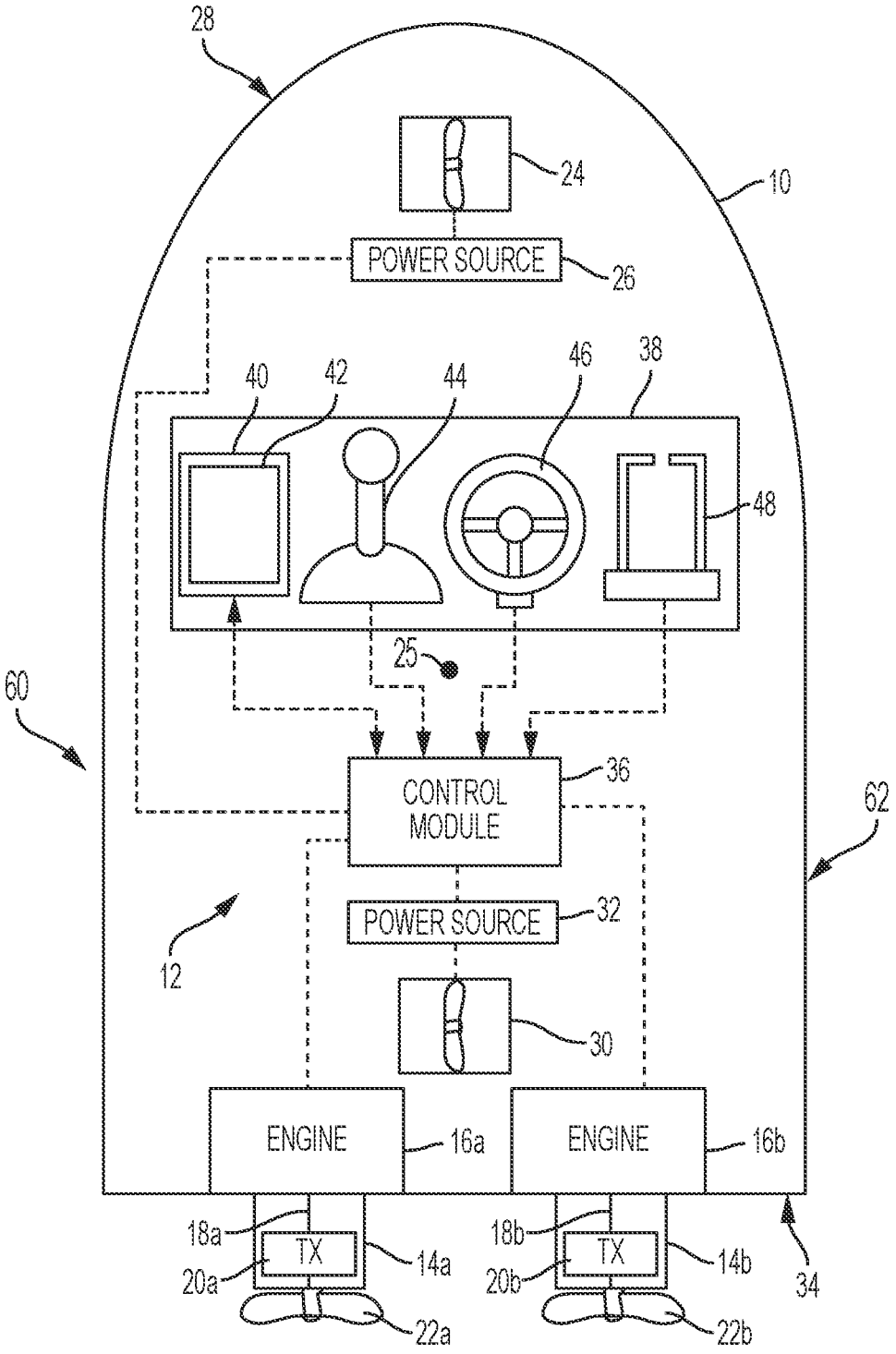
FIG. 1 is a schematic illustrating a marine vessel including a marine propulsion system according to the present disclosure.

FIG. 1 illustrates a marine vessel 10 including a marine propulsion system 12. The marine propulsion system 12 includes primary marine propulsion devices 14*a*, 14*b* coupled in torque-transmitting relationship with respective engines 16*a*, 16*b*. In the example shown herein, the primary marine propulsion devices 14*a*, 14*b* are an inboard motors; however, the primary marine propulsion devices 14*a*, 14*b* could instead be outboard motors, stern drives, pod drives, or jet drives. Additionally, as is known, one or more than two primary marine propulsion devices could be provided. As shown, output shafts 18*a*, 18*b* of the engines 16*a*, 16*b* are connected via transmissions 20*a*, 20*b* to propellers 22*a*, 22*b* of the primary marine propulsion devices 14*a*, 14*b*. However, other torque-transmitting arrangements could be provided. The marine propulsion system 12 also includes secondary marine propulsion devices 24, 30 coupled to respective sources 26, 32 of electric or hydraulic power. In the present example, the marine propulsion system 12 includes a secondary marine propulsion device 24 located at the bow 28 of the marine vessel 10 and a secondary marine propulsion device 30 located at the stern 34 of the marine vessel 10. In the present example, the secondary marine propulsion devices are therefore a bow thruster 24 and a stern thruster 30. In other examples, only a bow thruster 24 is provided. In still other examples, multiple thrusters are provided at the bow 28 and/or stern 34, and/or thrusters are provided elsewhere on the marine vessel 10, such as on the port side 60 and starboard side 62 thereof. In another example, as described in U.S. Pat. No. 9,988,134, a trolling motor is provided at the bow 28 and/or at the stern 34 of the marine vessel 10 in addition to the primary marine propulsion devices 14*a*, 14*b*.

In the example in which the secondary marine propulsion devices 24, 30 are thrusters, the exact type of thruster is not limiting on the scope of the present disclosure. As is known to those having ordinary skill in the art, bow and stern thrusters can be externally mounted, mounted in tunnels extending laterally through the hull of the marine vessel 10, or extendable out of and retractable into the hull. The thrusters 24, 30 can be steerable so as to vary a direction of thrust of the respective thruster, or can be fixed in place. The thrusters 24, 30 can be conventional propeller or impeller thrusters or water jet thrusters. The thrusters 24, 30 can produce thrust in two different directions, such as by varying the direction of rotation of their propellers or impellers or the direction of water discharged through their nozzles. The thrusters 24, 30 can be powered by an electric motor or by a hydraulic pump-motor system. For example, if the power sources 26, 32 are electric motors, they each include an output shaft, gear set, or transmission that rotates the propeller or impeller shaft of the secondary marine propulsion device 24, 30 or the pump shaft of a water pump. If the power sources 26, 32 are hydraulic pump-motor systems, each includes an electric pump and reservoir/tank and may include cooling and filtration components. The above-described types of thrusters 24, 30 are well known in the art and therefore will not be described further herein.

The marine propulsion system 12 also includes a control module 36 in signal communication with the primary marine propulsion devices 14*a*, 14*b* and the secondary marine propulsion devices 24, 30. The control module 36 is programmable and includes a processor and a memory. The control module 36 can be located anywhere in the marine propulsion system 12 and/or located remote from the marine propulsion system 12 and can communicate with various components of the marine vessel 10 via a peripheral interface and wired and/or wireless links, as will be explained further herein below. Although FIG. 1 shows one control module 36, the marine propulsion system 12 can include more than one control module. Portions of the method disclosed herein below can be carried out by a single control module or by several separate control modules. For example, the marine propulsion system 12 can have control modules located at or near a helm of the vessel 10 and can also have control modules located at or near the primary marine propulsion devices 14*a*, 14*b* and/or the secondary marine propulsion devices 24, 30. If more than one control module is provided, each can control operation of a specific device or sub-system on the marine vessel 10.

In some examples, the control module 36 may include a computing system that includes a processing system, storage system, software, and input/output (I/O) interfaces for communicating with peripheral devices. The systems may be implemented in hardware and/or software that carries out a programmed set of instructions. For example, the processing system loads and executes software from the storage system, such as software programmed with a method for actuating only one of the secondary marine propulsion devices 24, 30 and/or sequencing actuation of the secondary marine propulsion devices 24, 30, which directs the processing system to operate as described herein below in further detail. The computing system may include one or more processors, which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The storage system can comprise any storage media readable by the processing system and capable of storing software. The storage system can include volatile and non-volatile, removable and non-removable media implemented in any method or technology for storage of information, such as computer-readable instructions, data structures, software program modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The control module 36 communicates with one or more components of the marine propulsion system 12 via the I/O interfaces and a communication link, which can be a wired or wireless link. The control module 36 is capable of monitoring and controlling one or more operational characteristics of the marine propulsion system 12 and its various subsystems by sending and receiving control signals via the communication link. In one example, the communication link is a controller area network (CAN) bus, but other types of links could be used. It should be noted that the extent of connections of the communication link shown herein is for schematic purposes only, and the communication link in fact provides communication between the control module 36 and each of the peripheral devices noted herein, although not every connection is shown in the drawing for purposes of clarity.

The marine propulsion system 12 also includes a control console 38 having a number of user-operated input devices in signal communication with the control module 36. For instance, the control console 38 includes a multi-functional input device 40 having a user interface 42 including traditional (e.g., keypad) or screen-generated buttons that can be used to select of a number of operating modes of the marine vessel 10 and/or to input vessel movement commands. The control console 38 further includes a joystick 44 that is tiltable and rotatable to provide vessel movement commands to the control module 36, as will be described below. The control console 38 further includes a steering wheel 46 for inputting directional steering commands to the control module 36 and throttle/shift levers 48 for inputting engine gear and speed commands to the control module 36. The control module 36 processes each of these inputs and outputs corresponding steering and/or thrust commands to the primary propulsion devices 14*a*, 14*b* and secondary marine propulsion devices 24, 30.

Figure 2:
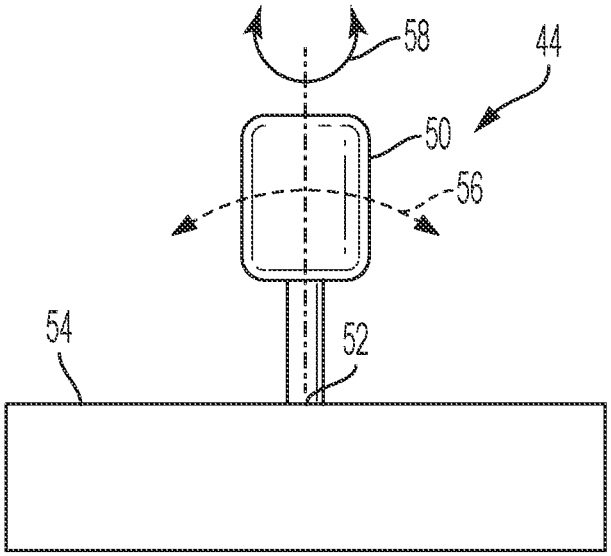
FIG. 2 is a schematic showing a side view of a joystick according to the present disclosure.

FIG. 2 is a simplified schematic representation of the joystick 44 as a manually operable analog input device to provide an input signal that represents a request for movement of the marine vessel 10. Note that there are many different types of joysticks and other input devices that can be used to provide a signal that is representative of a desired movement of the marine vessel 10. For example, various keypads, track balls, and/or other similar input devices could be used. The embodiment of FIG. 2 shows a joystick 44 having a handle 50 that is operatively coupled at a pivot 52 to a base 54 to allow manipulation of the joystick 44 by hand. In a typical application, the handle 50 provides lateral movement generally represented by arrow 56, longitudinal movement into and out of the plane of the drawing, and rotational movement as generally represented by arrow 58 either in a clockwise (CW) or a counterclockwise (CCW) direction. Although arrow 58 is illustrated in the plane of the drawing in FIG. 2, a similar type of movement is possible in other directions that are not parallel to the plane of the drawing.

Figure 3:
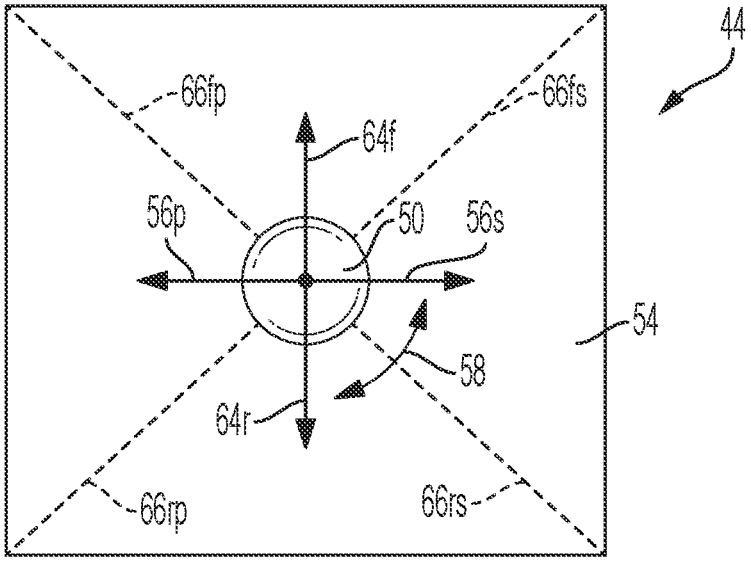
FIG. 3 is a schematic showing a top view of the joystick.

With reference to FIG. 3, which shows a top view of the joystick 44, it can be seen that the operator can request a purely lateral movement either toward the port side 60 as represented by arrow 56*p* or toward the starboard side 62 as represented by arrow 56*s*, a purely longitudinal movement in a forward direction towards the bow 28 as represented by arrow 64*f* or in a reverse direction towards the stern 34 as represented by arrow 64*r*, or combinations of these directions. The handle 50 can also move in various directions in addition to those described above, including those represented by dashed lines 66*fp*, 66*fs*, 66*rp*, and 66*rs*. For example, by moving the handle 50 along dashed line 66*fs*, a translational movement toward the starboard side and forward can be requested. It should be understood that the operator of the marine vessel can also request a combination of lateral movement, longitudinal movement, or both, also in combination with a rotation as represented by arrow 58. In fact, it should be understood that the handle 50 can move in any direction relative to its axis at pivot 52 and is not limited to the lines of movement represented by the arrows and dashed lines. In fact, the movement of the handle 50 has a virtually infinite number of possible paths as it is tilted about its pivot 52 within the base 54. Any request provided via the joystick 44 is then communicated to the control module 36.

The magnitude, or intensity, of movement represented by the position of the handle 50 is also provided from the joystick 44 to the control module 36. For example, if the handle 50 is moved slightly toward one side or the other, the requested thrust is less than if, alternatively, the handle 50 was moved by a greater magnitude away from its vertical position with respect to the base 54. Furthermore, rotation of the handle 50 about the pivot 52, as represented by arrow 58, provides a signal representing the intensity of desired movement. A slight rotation of the handle 50 would represent a request for a slight thrust to rotate the marine vessel 10. On the other hand, a more intense rotation of the handle 50 would represent a command for a higher magnitude of rotational thrust. In this regard, the joystick 44 provides both steering and thrust commands to the control module 36.

The joystick 44 can also provide information to the control module 36 regarding its being in an active state or an inactive state. While an operator is manipulating the joystick 44, the joystick 44 is in an active state. However, if the operator releases the joystick 44 and allows its handle 50 to return to a neutral (e.g., centered/upright) position above the pivot 52, the joystick 44 reverts to an inactive state. In one example, movement of the handle 50 away from the centered state or rotation of the handle 50 about its axis, or both, causes the control module 36 to determine that the joystick 44 is in the active state and subsequently to act on the commands from the joystick 44, regardless of the position of the throttle/shift levers 48 or steering wheel 46. In another example, either or both of the throttle/shift levers 48 and steering wheel 46 must be in a detent position before movement of the joystick 44 will result in the control module 36 determining that the joystick 44 is in the active state and subsequently acting on the commands from the joystick 44. In one example, the detent position of the throttle/shift levers 48 is a forward, neutral, or reverse detent position. The detent position of the steering wheel 46 may be a zero-degree (straight ahead) position.

In one mode, the throttle/shift levers 48 and the steering wheel 46 can be used to send inputs requesting movement of the marine vessel 10 to the control module 36 to operate the primary marine propulsion devices 14*a*, 14*b* in response to such commands, as is conventional and known to those having ordinary skill in the art.

It is also known to operate the marine vessel 10 in a thruster-only mode after initiating such mode via a user input at the control console 38. For example, the operator of the marine vessel 10 can make a selection via the user interface 42 or via a separate thruster-only mode button to enable such a thruster-only mode. In this mode, only the secondary marine propulsion devices 24, 30 are powered to move the marine vessel 10 according to commands input via one of the user input devices, such as, for example, the joystick 44, or forward, aft, port, and starboard arrow buttons provided at the user interface 42. In such a thruster-only mode, the engines 16*a*, 16*b* are off, and inputs to the steering wheel 46 and the throttle/shift levers 48 are ignored. The thruster-only mode can be disabled by way of a selection made via the user interface 42 or the separate thruster-only mode button at the control console 38.

Additionally, it is known to operate the marine propulsion system 12 in a mode in which the primary marine propulsion devices 14*a*, 14*b* and the secondary marine propulsion devices 24, 30 are actuated at the same time and/or in varying combinations in order to carry out requested movements of the marine vessel 10. For example, if the joystick 44 is manipulated in order to request both translation and rotation of the marine vessel 10, the primary marine propulsion devices 14*a*, 14*b* can be powered to provide a thrust via the propellers 22*a*, 22*b*, while a rudder or other steerable component is rotated to change a direction of the marine vessel 10. (In the event that the primary marine propulsion devices 14*a*, 14*b* are steerable propulsion devices, the primary marine propulsion devices 14*a*, 14*b* themselves could be rotated to change the direction of thrust from the propellers 22*a*, 22*b*.) At the same time, one or both of the secondary marine propulsion devices 24, 30 may be actuated to provide thrust to rotate the marine vessel 10 in the requested direction. By way of various combinations of thrusts provided by the primary marine propulsion devices 14*a*, 14*b* and one or both of the secondary marine propulsion devices 24, 30, many different movements of the marine vessel 10 can be accomplished, as is known to the those having ordinary skill in the art. Additionally, even more complex maneuvers may be carried out if the marine vessel 10 is equipped with two or more steerable primary marine propulsion devices in addition to the secondary marine propulsion devices 24, 30.

One marine vessel movement that may be accomplished or aided by thrust from the secondary marine propulsion devices 24, 30 is rotation of the marine vessel 10 about a predetermined point 25, such as a center or gravity or a center of pressure, as known to those having ordinary skill in the art. Yawing in a clockwise direction can be accomplished by actuating the bow thruster 24 to produce thrust in a port direction and/or actuating the stern thruster 30 to produce thrust in a starboard direction, while yawing in a counter-clockwise direction can be accomplished by actuating the bow thruster 24 to produce thrust in the starboard direction and/or actuating the stern thruster 30 to produce thrust in the port direction. Through research and development, the present inventors realized that it may not always be desirable to actuate both the secondary marine propulsion devices 24, 30 to accomplish such yawing of the marine vessel 10. By way of example, if the marine vessel 10 is pulled up alongside a dock, and the rear side of the marine vessel 10 is already touching or nearly touching the dock, it may be desirable to move just the front end of the marine vessel 10 toward the dock without moving the rear end away from the dock. Such a maneuver might be particularly helpful for controlling a long marine vessel such as a house boat, where lateral thrust at one end does not have a great affect on movement at the other end of the marine vessel. The present inventors also discovered that it would be beneficial to be able to be able to actuate only one of the secondary marine propulsion devices 24, 30 at a time using a user input device such as the joystick 44, which provides an intuitive interface for commanding slower, more precise docking maneuvers.

Figure 4:
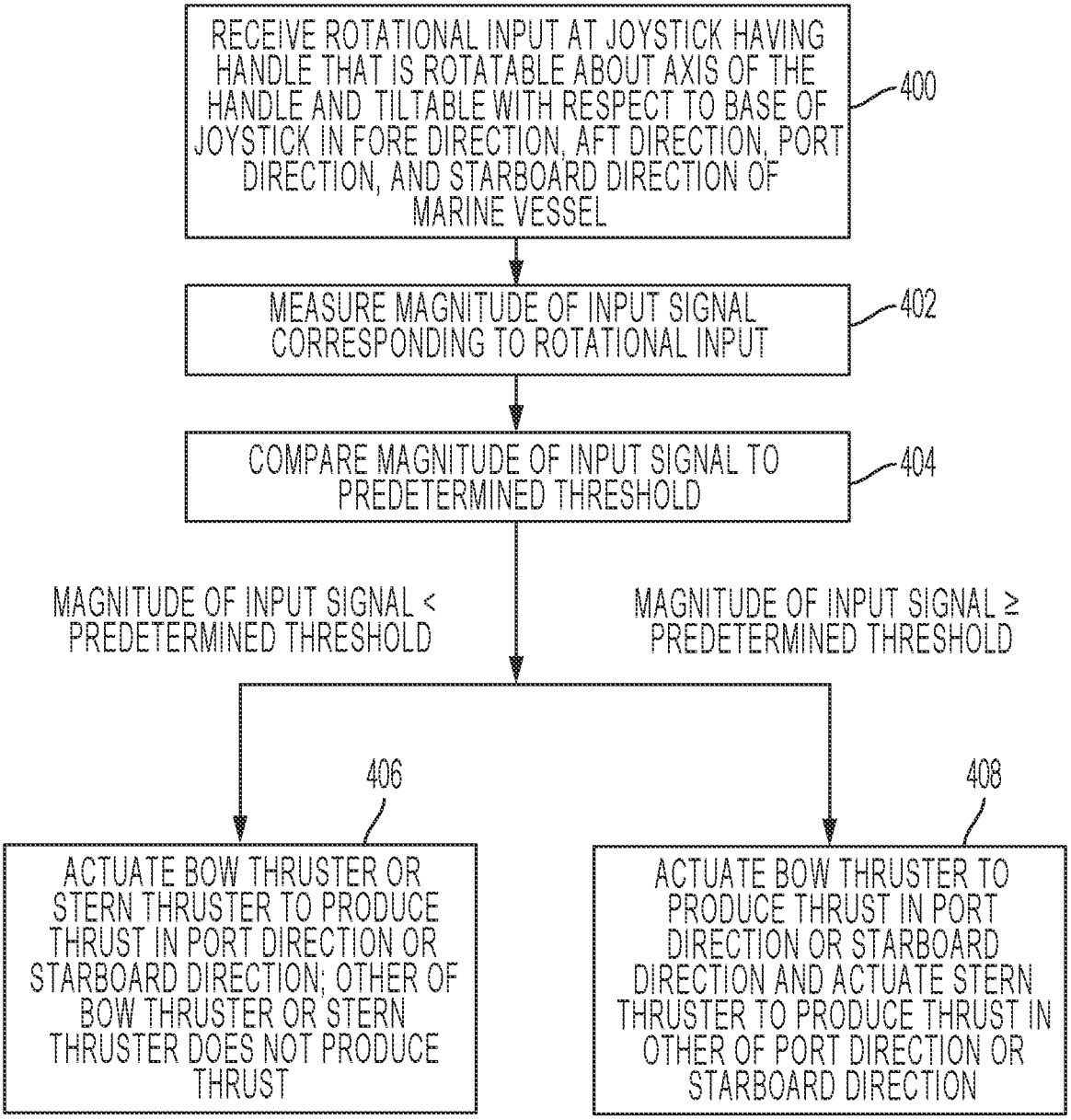
FIG. 4 illustrates a method according to the present disclosure.

A method for maneuvering a marine vessel according to one example of the present disclosure is shown in FIG. 4. As shown at 400, the method includes receiving a rotational input at a joystick 44 having a handle 50 that is rotatable about an axis of the handle 50 and tiltable with respect to a base 54 of the joystick 44 in a fore direction, an aft direction, a port direction, and a starboard direction of the marine vessel 10 (i.e., along arrows 64*f*, 64*r*, 56*p*, and 56*s*, respectively). Such movement of the joystick 44 was described herein above with respect to FIGS. 2 and 3. As shown at 402, the method includes measuring a magnitude of an input signal corresponding to the rotational input via the joystick 44. This can be done, for example, by a sensor such as a potentiometer in the joystick 44 that measures rotation of the handle 50 about its axis with respect to the neutral, non-rotated position. This measurement is sent to the control module 36, where, as shown at 404, the method includes comparing the magnitude of the input signal to a predetermined threshold. In one example, the predetermined threshold is 50% of the joystick handle's available rotation in a given direction (CW or CCW) from the neutral, non-rotated position. For example, if the joystick's handle 50 can be rotated 90 degrees in the CW direction and 90 degrees in the CCW direction, the predetermined threshold might be 45 degrees in either direction. The 50% threshold is only an example, and other thresholds could be calibrated by the manufacturer or programmed by the user into the memory of the control module 36. In general, the threshold should be great enough that it represents a movement that is perceivable to the user, such that the user is able to control whether the handle 50 is rotated beyond the predetermined threshold or not. Thus, any magnitude representing between about 25% and 75% of the joystick handle's available rotation in one direction or the other might be appropriate for the threshold.

In response to the magnitude of the input signal being less than the predetermined threshold, the method includes actuating one of the bow thruster 24 or the stern thruster 30 to produce thrust in one of the port direction or the starboard direction, as shown at 406. According to the present method, the other of the bow thruster 24 or the stern thruster 30 does not produce thrust when the magnitude of the input signal is less than the predetermined threshold. In this way, the user is able to actuate just one of the thrusters 24, 30 using the joystick 44 so as to move only the bow 28 or only the stern 34 of the marine vessel 10 without moving the other end (or minimally moving the other end). Whether it is the bow thruster 24 or the stern thruster 30 that is actuated may depend on what other inputs are made to the joystick 44. For example, if the joystick's handle 50 is only rotated, with no tilting about the pivot 52, the method may include actuating only the bow thruster 24 to produce thrust.

Similarly, when the method includes receiving a tilt input at the joystick 44, in response to the magnitude of the input signal being less than the predetermined threshold and the tilt input being in the fore direction (along arrow 64*f*) or in the fore direction combined with the port or starboard direction (e.g., along dashed lines 66*fp* or 66*fs*), the method includes actuating only the bow thruster 24 to produce thrust. However, in response to the magnitude of the input signal being less than the predetermined threshold and the tilt input being in the aft direction (along arrow 64*r*) or in the aft direction combined with the port or starboard direction (e.g., along dashed lines 66*rp* or 66*rs*), the method includes actuating only the stern thruster 30 to produce thrust. In the former instance, it is assumed that the user wants to move the bow 28 of the marine vessel 10 first due to the fore-directed input command. In the latter instance, it is assumed that the user wants to move the stern 34 of the marine vessel 10 first due to the aft-directed input command.

When a tilt input is received at the joystick 44 in purely a port or a starboard direction (along arrow 56*p* or 56*s*), along with a rotational input about the handle axis that is less than the predetermined threshold, either the bow thruster 24 or the stern thruster 30 can be the sole thruster actuated. Whether it is the bow thruster 24 or the stern thruster 30 that is actuated can depend on the direction in which the handle 50 is rotated. For example, the bow thruster 24 can be actuated if the handle 50 is rotated CW, and the stern thruster 30 can be actuated if the handle is rotated CCW, or vice versa. In another example, the bow thruster 24 is actuated no matter which direction the handle 50 is rotated. In still another example, the user can select which thruster 24 or 30 is to be actuated upon rotation of the handle 50 in a given direction by less than the predetermined threshold. Further examples of responses to tilt inputs in the port or starboard direction in combination with rotational inputs will be described herein below with respect to FIGS. 5, 6, and 7. It should be understood that the input-output maps shown herein are only exemplary, and the system can be calibrated in many different ways depending on the desired effect.

As shown at 408, in response to the magnitude of the input signal being greater than or equal to the predetermined threshold, the method further incudes actuating the bow thruster 24 to produce thrust in one of the port direction or the starboard direction and actuating the stern thruster 30 to produce thrust in the other of the port direction or the starboard direction. In this instance, it is assumed that the user wanted to rotate the marine vessel 10 with more thrust, and thus both thrusters 24, 30 are actuated to provide that thrust. In other words, the user can control whether only the bow 28 or the stern 34 of the marine vessel 10 is moved by moderating the user's rotational input to the joystick's handle 50.

Whether the thrusters 24, 30 produce thrust in the port direction or the starboard direction is dictated by the direction of rotation (CW or CCW) of the joystick's handle 50. As will be described with respect to FIGS. 5, 6, and 7, the control module 36 sends signals to actuate the thrusters 24 and/or 30 as determined according to the comparison between the input signal corresponding to the rotational input and the predetermined threshold as well as according to an additional input signal corresponding to a direction of tilt of the joystick's handle 50. The control module 36 may use a look-up table or other input-output map to determine the thruster 24 and/or 30 that will produce thrust and in what direction, such as the tables provided in FIGS. 5, 6, and 7.

An exemplary map of the inputs to the joystick 44 and the corresponding outputs from the thrusters 24, 30 is provided in FIG. 5. For example, the cell 502 shows how if the handle 50 is rotated clockwise about its axis by greater than the predetermined threshold, and also tilted about its pivot 52 in the fore direction, the bow thruster 24 will produce a port-directed thrust and the stern thruster 30 will produce a starboard-directed thrust. Note that the column labeled "fore" includes diagonal movements of the joystick's handle 50 in the combined fore and port or fore and starboard directions, and the column labeled "aft" includes diagonal movements of the joystick's handle 50 in the combined aft and port or aft and starboard directions. The column labeled "port/stbd" represents movements of the joystick's handle 50 purely in the port or starboard direction, with no fore or aft component. The "port/stbd" column in this table is calibrated to override the operator's sidle command (i.e., purely port or starboard tilt input) and instead produce yaw in response to any rotational input to the joystick's handle 50. The cells 504 and 506 show that in this example, when rotational input to the joystick 44 is less than the threshold, only the bow thruster 24 is actuated to produce yaw by moving the bow 28, but it should be understood that the stern thruster 30 could be actuated in the opposite direction in order to achieve yaw in the same rotational direction, but by moving the stern 34. As noted herein above, whether the bow or stern thruster 24, 30 is the one to produce thrust when the tilt input is purely in the port or starboard direction and the rotational input signal is less than the threshold can be calibrated or selected by the user. Cell 508 shows how when the joystick 44 is rotated CW by greater than the threshold and tilted purely to port or starboard, the bow thruster 24 produces a port-directed thrust, and the stern thruster 30 produces a starboard-directed thrust, thus providing more thrust to yaw the marine vessel 10 than actuating only the bow thruster 24 to produce a port-directed thrust (compare cell 504).

FIG. 6 shows an exemplary look-up table in which the response when the joystick's handle 50 is tilted purely in the port or starboard direction is to ignore any rotational input to the joystick 44 unless it is greater than the threshold. For instance, cells 602 and 604 show how if the rotational input (CW or CCW) is less than the threshold, and the tilt input is purely to starboard (56*s*), both thrusters 24, 30 will produce thrust towards port, thus moving the marine vessel 10 towards starboard. In other words, the operator's sidle command is acted upon. Cell 606, on the other hand, shows how if the rotational input is greater than the threshold, the operator's yaw request is acted upon; the bow thruster 24 produces thrust to starboard, and the stern thruster 30 produces thrust to port, to produce a CCW yaw according to the operator's command. Note that the columns "none," "fore," and "aft" remain the same as in FIG. 5.

FIG. 7 shows an exemplary look-up table in which the response when the joystick's handle 50 is tilted purely in the port or starboard direction is dependent on whether the tilt is purely to port (56*p*) or purely to starboard (56*s*). This table is calibrated in the "port" and "stbd" columns such that the marine vessel 10 will always move in the direction that the joystick's handle is tilted while producing yaw in the direction of rotation when the rotational input is less than the threshold. For example, cell 702 shows how when the rotational input is CCW and less than the threshold, and the tilt input is purely to port, the bow thruster 24 produces thrust to starboard, which not only rotates the vessel CCW, but also provides movement of the bow 28 in the port direction. This may be desirable if the operator is manipulating the joystick 44 to move the marine vessel 10 closer to a dock. Note that the columns "none," "fore," and "aft" remain the same as in FIG. 5.

A method according to another example of the present disclosure is shown in FIG. 8. As shown at 800, the method includes receiving from a user input device an input signal comprising a command to rotate the marine vessel 10 about a predetermined point 25 on the marine vessel 10. As noted herein above, in one example, the user input device is the joystick 44, although a touch screen rendered at the user interface 42, a trackball, or other user input device capable of receiving a rotational input could instead be used. As shown at 802, the method includes comparing a magnitude of the input signal to a predetermined threshold, as was described hereinabove. The predetermined threshold can be any calibrated value, but preferably is a value corresponding to manipulation of the user input device that is able to be perceived by the user, for reasons explained herein above. As shown at 804, in response to the magnitude of the input signal being less than the predetermined threshold, the method includes actuating a first marine propulsion device located at one of a bow 28 or a stern 34 of the marine vessel 10 to produce thrust in one of a port or a starboard direction of the marine vessel 10. The second marine propulsion device does not produce thrust when the magnitude of the input signal is less than the predetermined threshold. As noted in the example hereinabove, the first marine propulsion device is one of a bow thruster 24 or a stern thruster 30, and the second marine propulsion device is the other of the bow thruster 24 or the stern thruster 30.

The method may further comprise receiving an additional input signal from the user input device comprising a command to translate the marine vessel 10 in the fore direction, in the aft direction, in the port direction, in the starboard direction, in the fore direction combined with the port or starboard direction, or in the aft direction combined with the port or starboard direction. In response to receiving the additional input signal comprising the command to translate the marine vessel 10 in the fore direction or in the fore direction combined with the port or starboard direction, the first marine propulsion device is the one that is located at the bow (e.g., the bow thruster 24), and the second marine propulsion device is the one that is located at the stern (e.g., the stern thruster 30). In response to receiving the additional input signal comprising the command to translate the marine vessel 10 in the aft direction or in the aft direction combined with the port or starboard direction, the first marine propulsion device is the one that is located at the stern (e.g., the stern thruster 30), and the second marine propulsion device is the one that is located at the bow (e.g., the bow thruster 24).

As shown at 806, in response to the magnitude of the input signal being greater than or equal to the predetermined threshold, the method includes actuating the first marine propulsion device to produce thrust in the one of the port or the starboard direction and actuating the second marine propulsion device located at the other of the bow 28 or the stern 34 to produce thrust in the other of the port or the starboard direction. Again, it is assumed in this situation that the greater rotation of the user input device signifies the user's desire to yaw the marine vessel with greater thrust, rather that simply to move the bow 28 or stern 34 of the marine vessel 10 while maintaining the other of the bow 28 or the stern 34 relatively stationary.

Figure 9:
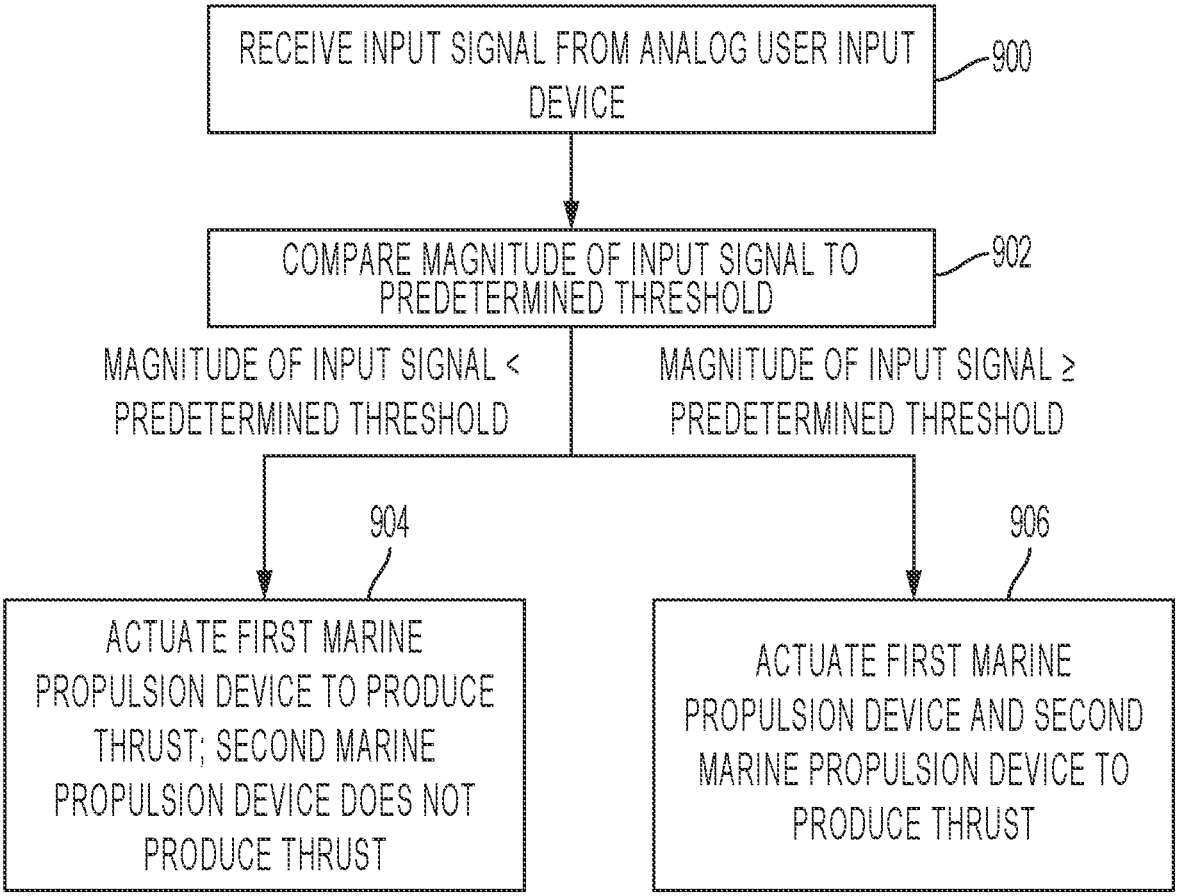
FIG. 9 illustrates another method according to the present disclosure.

A method for maneuvering a marine vessel 10 according to another example is shown in FIG. 9. The method comprises receiving an input signal from an analog user input device, as shown at 900. The analog user input device is one that accepts other than just discrete (digital) input, and instead can receive continuous user input and create a continuous electronic signal in response thereto. Thus, the user is able to manipulate the user input device between an OFF position and various different ON positions, some of which are above the predetermined threshold and some of which are below the predetermined threshold. In one example, the analog user input device is the joystick 44, although other known user input devices could instead be used, as described hereinabove. In one example, the input signal comprises a command to rotate the marine vessel 10 about a predetermined point 25 on the marine vessel 10. The input signal originated at the analog input device is received at the control module 36, and the method next includes comparing a magnitude of the input signal to a predetermined threshold, as shown at 902. The predetermined threshold can be any calibrated value, but preferably is a value corresponding to input to the user input device that is able to be perceived by the user, for reasons explained hereinabove. As shown at 904, in response to the magnitude of the input signal being less than the predetermined threshold, the method includes actuating a first marine propulsion device to produce thrust. According to the method, a second marine propulsion device does not produce thrust when the magnitude of the input signal is less than the predetermined threshold.

The method may further comprise receiving an additional input signal from the user input device comprising a command to translate the marine vessel 10 in the fore direction, in the aft direction, in the port direction, in the starboard direction, in the fore direction combined with the port or starboard direction, or in the aft direction combined with the port or starboard direction. In response to receiving the additional input signal comprising the command to translate the marine vessel 10 in the fore direction or in the fore direction combined with the port or starboard direction, the first marine propulsion device is one that is located at a bow 28 of the marine vessel 10, and the second marine propulsion device is one that is located at a stern 34 of the marine vessel 10. In response to receiving the additional input signal comprising the command to translate the marine vessel 10 in the aft direction or in the aft direction combined with the port or starboard direction, the first marine propulsion device is one that is located at a stern 34 of the marine vessel 10, and the second marine propulsion device is one that is located at a bow 28 of the marine vessel 10.

As shown at 906, in response to the magnitude of the input signal being greater than or equal to the predetermined threshold, the method includes actuating the first marine propulsion device and the second marine propulsion device to produce thrust. Again, it is assumed in this situation that the greater rotation of the user input device signifies the user's desire to yaw the marine vessel 10 with greater thrust, rather that simply to move the bow 28 or stern 34 of the marine vessel 10 while maintaining the other of the bow 28 or the stern 34 relatively stationary.

According to method, the first and second marine propulsion devices produce thrust in a port-starboard direction of the marine vessel 10, and the method further comprises actuating the first marine propulsion device to produce one of a port-directed thrust or a starboard-directed thrust and actuating the second marine propulsion device to produce the other of the port-directed thrust or the starboard-directed thrust in response to the magnitude of the input signal being greater than or equal to the predetermined threshold. In one example, as described herein above, the first marine propulsion device is one of a bow thruster 24 or a stern thruster 30, and the second marine propulsion device is the other of the bow thruster 24 or the stern thruster 30. For example, the bow thruster 24 may produce thrust in a port direction and the stern thruster 30 may produce thrust in a starboard direction in order to rotate the marine vessel 10 CW when the magnitude of the input signal from the user input device exceeds the predetermined threshold.

In one example, the bow and stern thrusters 24, 30 are configured as non-proportional output devices. In other words, the power provided by the power sources 26, 32 to the respective thrusters 24, 30 is not proportional to the magnitude of the input to the joystick 44, but rather is simply OFF or ON. That is, when the handle 50 of the joystick 44 is rotated by less than the predetermined threshold, one of the thrusters is ON and the other is OFF. When the handle 50 of the joystick 44 is rotated by more than the predetermined threshold, both of the thrusters are ON. However, the thrusters 24, 30 could instead be configured as proportional thrusters, such that the thrust they produce is varied based on the magnitude of the input to the joystick 44.

Note that although the examples of FIG. 4 is described with respect to using two thrusters to produce thrust at the bow 28 and stern 34 of the marine vessel 10, any two or more marine propulsion devices capable of producing thrust or a resultant thrust in a port-starboard direction could be used. For instance, the marine propulsion device at the bow 28 of the marine vessel 10 could be a trolling motor that is rotatable at least 180 degrees to produce thrust in the port-starboard direction. An example of this arrangement is provided in U.S. Pat. No. 9,988,134. The marine propulsion devices at the stern 34 of the marine vessel 10 could be primary propulsion devices such as steerable outboard motors, pod drives, or the like, which are capable of being steered to together produce a resultant thrust in primarily or only the port-starboard direction. Examples of how two or more primary propulsion deices can be actuated to provide such thrust are described in U.S. Pat. Nos. 7,467,595; 8,805,057; 9,132,903; and 9,434,460. Combinations of thrusters and trolling motors, thrusters and primary propulsion devices, or trolling motors and primary propulsion devices are also contemplated within the scope of the present disclosure.

The methods of the present disclosure describe how a first marine propulsion device is actuated when a user input device is manipulated to produce an input signal that is less than a predetermined threshold magnitude, and how both the first marine propulsion device and the second marine propulsion device are actuated when the user input device is manipulated to produce an input signal that exceeds the predetermined threshold magnitude. Note that actuation of the first and second marine propulsion devices could be accomplished sequentially or at the same time, depending on the inputs to the user input device. For example, if the user input device is manipulated quickly to a position corresponding to an input signal that is greater than the threshold magnitude, such that the input signal is less than the threshold magnitude for shorter than a given amount of time, both the first and second marine propulsion devices may be actuated at the same time initially. On the other hand, if the user input device is manipulated slowly to a position corresponding to an input signal that is greater than the threshold magnitude, such that the input signal is less than the threshold magnitude for longer than the given amount of time, only the first marine propulsion device might be actuated while the user input device has the position corresponding to the input signal that is less than the threshold magnitude. Once the user input device is manipulated to the position corresponding to the input signal that is greater than the threshold magnitude, the second marine propulsion device may then be actuated, such that thereafter both the first and second marine propulsion devices produce thrust at the same time. In another example, the first and second marine propulsion devices are actuated sequentially no matter how quickly the user input device is manipulated through the positions corresponding to input signals less than the threshold magnitude.

As the user manipulates the user input device back to the neutral, start position, the opposite sequence may occur. That is, if the user manipulates the user input device from a position corresponding to a signal that is greater than or equal to the threshold magnitude (with both first and second marine propulsion devices producing thrust) to a position corresponding to a signal that is less than the threshold magnitude, the control module 36 may control the second marine propulsion device to stop producing thrust. In another example, the first and second marine propulsion devices both continue to produce thrust while the user returns the user input device to the neutral position.

The above-described methods can be employed in conjunction with various operating modes of the marine propulsion system 12 described herein above. For example, the above-described methods can be available when the marine propulsion system 12 is operating in the normal operating mode, as the user rotates the steering wheel 46 to steer and uses the throttle/shift levers 48 to command the primary marine propulsion devices 14*a*, 14*b* to produce thrust. Manipulation of the joystick 44, in one example, can temporarily switch the system to operation according to the above-described methods of the present disclosure. In another example, as noted hereinabove, the throttle/shift levers 48 and the steering wheel 46 must be in neutral, detent positions before manipulation of the joystick 44 can initiate the presently disclosed methods. By way of another example, the present methods may be initiated while the marine propulsion system 12 is operating in the joy sticking mode, which can be initiated as described hereinabove. The joysticking mode would be modified to interpret rotational/yaw commands input to the joystick 44 according to the above-noted algorithms. For example, rather than a slight rotation of the joystick's handle 50 being interpreted as a request for only a small rotation of the marine vessel 10 using all available propulsion devices, a slight rotation of the joystick's handle 50 (i.e., producing an input signal less than the predetermined threshold) would be interpreted as a command to actuate only a marine propulsion device(s) at the bow 28 or stern 34 of the marine vessel 10. The thrust provided by the propulsion device(s) at the bow 28 or stern 34 could be discrete (i.e., ON/OFF) or proportional to the degree of joystick rotation, as described herein above. Additionally, the present methods may also be available in the "thruster only" mode, which was also described hereinabove. Finally, the present methods may be available only after selection of a particular operating mode, such as via the user interface 42.

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims. Each limitation in the appended claims is intended to invoke interpretation under 35 USC § 112(f), only if the terms "means for" or "step for" are explicitly recited in the respective limitation.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

What is claimed is:

1. A method for maneuvering a marine vessel, the method being carried out by a control module and comprising:

receiving an input signal corresponding only to a command to rotate the marine vessel about a predetermined point on the marine vessel, the input signal being generated by rotation of a handle of a single user input device about an axis of the handle;

comparing a magnitude of the input signal to a predetermined threshold;

in response to the magnitude of the input signal being less than the predetermined threshold, actuating a first marine propulsion device in a manner that will cause the marine vessel to yaw according to the command; and in response to the magnitude of the input signal being greater than or equal to the predetermined threshold, actuating the first marine propulsion device and a second marine propulsion device in manners that will cause the marine vessel to yaw according to the command;

wherein the control module does not actuate the second marine propulsion device in response to the magnitude of the input signal being less than the predetermined threshold.

2. The method of claim 1, wherein the first marine propulsion device is located at one of a bow or a stern of the marine vessel and the second marine propulsion device is located at the other of the bow or the stern.

3. The method of claim 2, wherein the first marine propulsion device is one of a bow thruster or a stern thruster, and the second marine propulsion device is the other of the bow thruster or the stern thruster.

4. The method of claim 3, wherein the input signal is an analog input signal, and wherein the bow and stern thrusters are configured as non-proportional output devices.

5. The method of claim 3, further comprising receiving from the user input device an additional command to translate the marine vessel purely in a port direction or purely in a starboard direction, wherein in response to the additional command, the control module actuates both the bow and stern thrusters to cause the marine vessel to translate in the port or starboard direction, regardless of the magnitude of the input signal.

6. The method of claim 1, wherein the user input device is a joystick.

7. A method for maneuvering a marine vessel, the method being carried out by a control module and comprising:

receiving from a single user input device an input signal corresponding only to a command to rotate the marine vessel about a predetermined point on the marine vessel;

comparing a magnitude of the input signal to a predetermined threshold;

in response to the magnitude of the input signal being less than the predetermined threshold, actuating one of a bow thruster and a stern thruster in a manner that will cause the marine vessel to yaw according to the command; and in response to the magnitude of the input signal being greater than or equal to the predetermined threshold, actuating both the bow thruster and the stern thruster in manners that will cause the marine vessel to yaw according to the command;

wherein the control module does not actuate the other of the bow thruster and the stern thruster in response to the magnitude of the input signal being less than the predetermined threshold.

8. The method of claim 7, wherein the user input device has a handle that is rotatable about an axis of the handle and the input signal is generated by rotation of the handle about the axis.

9. The method of claim 8, wherein the user input device is a joystick.

10. The method of claim 7, wherein the input signal is an analog input signal, and wherein the bow and stern thrusters are configured as non-proportional output devices.

11. The method of claim 7, further comprising receiving from the user input device an additional command to translate the marine vessel purely in a port direction or purely in a starboard direction, wherein in response to the additional command, the control module actuates both the bow and stern thrusters to cause the marine vessel to translate in the port or starboard direction, regardless of the magnitude of the input signal.

12. A method for maneuvering a marine vessel, the method being carried out by a control module and comprising:

receiving from a single user input device an input signal comprising a command to rotate the marine vessel about a predetermined point on the marine vessel;

comparing a magnitude of the input signal to a predetermined threshold;

in response to the magnitude of the input signal being less than the predetermined threshold, actuating a first marine propulsion device in a manner that will cause the marine vessel to yaw according to the command; and in response to the magnitude of the input signal being greater than or equal to the predetermined threshold, actuating the first marine propulsion device and a second marine propulsion device in manners that will cause the marine vessel to yaw according to the command;

wherein the control module does not actuate the second marine propulsion device in response to the magnitude of the input signal being less than the predetermined threshold;

wherein the first marine propulsion device is located at one of a bow or a stern of the marine vessel and the second marine propulsion device is located at the other of the bow or the stern; and wherein the method further comprises receiving from the user input device an additional command to translate the marine vessel purely in a port direction or purely in a starboard direction, wherein in response to the additional command, the control module actuates both the first and second marine propulsion devices to cause the marine vessel to translate in the port or starboard direction, regardless of the magnitude of the input signal.

13. The method of claim 12, wherein the user input device has a handle that is rotatable about an axis of the handle and the input signal is generated by rotation of the handle about the axis.

14. The method of claim 13, wherein the user input device is a joystick.

15. The method of claim 12, wherein the first marine propulsion device is one of a bow thruster or a stern thruster, and the second marine propulsion device is the other of the bow thruster or the stern thruster.

16. The method of claim 15, wherein the input signal is an analog input signal, and wherein the bow and stern thrusters are configured as non-proportional output devices.

* * * * *